US010830225B2

(12) United States Patent
Repaci

(10) Patent No.: US 10,830,225 B2
(45) Date of Patent: Nov. 10, 2020

(54) COMPRESSION UNIT FOR A VOLUMETRIC COMPRESSOR WITHOUT LUBRIFICATION

(71) Applicant: MGF S.r.l., Abbiategrasso (Milan) (IT)

(72) Inventor: Massimo Repaci, Abbiategrasso (IT)

(73) Assignee: MGF S.R.L., Abbiategrasso (IT)

( * ) Notice: Subject to any disclaimer, the term of this patent is extended or adjusted under 35 U.S.C. 154(b) by 237 days.

(21) Appl. No.: 15/711,443

(22) Filed: Sep. 21, 2017

(65) Prior Publication Data

US 2018/0087493 A1 Mar. 29, 2018

(30) Foreign Application Priority Data

Sep. 21, 2016 (IT) ..... 102016000094897

(51) Int. Cl.

*F04B 39/16* (2006.01)
*F04B 39/12* (2006.01)
*F04B 39/06* (2006.01)
*F04B 39/00* (2006.01)

(52) U.S. Cl.

CPC ..... *F04B 39/16* (2013.01); *F04B 39/064* (2013.01); *F04B 39/066* (2013.01); *F04B 39/121* (2013.01); *F04B 39/123* (2013.01); *F04B 39/126* (2013.01); *F04B 39/128* (2013.01); *F04B 39/0094* (2013.01)

(58) Field of Classification Search

CPC .. F04B 39/123; F04B 39/121; F04B 39/0094; F04B 39/16; F04B 39/128; F04B 39/126; F04B 39/066; F04B 39/064

USPC ..... 417/255

See application file for complete search history.

(56) References Cited

U.S. PATENT DOCUMENTS 973,739 A * 10/1910 Alvergnat
2,899,130 A * 8/1959 Sykes ..... F04B 25/005 417/243
3,204,865 A * 9/1965 Neubauer ..... F04B 39/04 417/255
3,237,852 A * 3/1966 Shaw ..... F04B 35/04 417/372
3,692,434 A * 9/1972 Schnear ..... F04B 27/053 417/360
4,979,878 A * 12/1990 Short ..... F04B 53/14 417/255

(Continued)

FOREIGN PATENT DOCUMENTS

GB 529227 * 11/1940

*Primary Examiner* — Charles G Freay
(74) *Attorney, Agent, or Firm* — Tutunjian & Bitetto, P.C.

(57) ABSTRACT

A compression unit, for a volumetric compressor, includes at least one cylinder, at least one piston, a drive shaft, operable in rotation around a rotation axis and associated with the at least one piston through a connecting rod/crankshaft kinematic mechanism, a casing for supporting the at least one cylinder and for housing at least one portion of the drive shaft and of the connecting rod/crankshaft kinematic mechanism, and which includes at least one air intake in communication with the outside of the compression unit and defining at least one passage for the air to be drawn therein and to be supplied to the at least one cylinder; the air intake is in fluid communication with the interior of the at least one cylinder through a path which is extended inside the casing and through at least one section of a wall of the at least one cylinder.

13 Claims, 4 Drawing Sheets

(56) References Cited

U.S. PATENT DOCUMENTS

2015/0147208 A1* 5/2015 Chen ..... F04B 39/066
417/423.8

* cited by examiner

COMPRESSION UNIT FOR A VOLUMETRIC COMPRESSOR WITHOUT LUBRIFICATION

TECHNICAL FIELD OF THE INVENTION

The present invention regards a compression unit usable in a compressor of the type lacking the aid of additional lubrication, for the compression of a work fluid such as air.

STATE OF THE ART

Volumetric compressors of the type lacking the aid of additional lubrication are known—otherwise defined dry compressors—which comprise at least one compression unit provided with at least one cylinder within which a piston is actuated with reciprocating motion, moving closer to or further away from a closure head of the cylinder. The reciprocating motion of the piston within the cylinder activates a cycle of suction, compression and delivery for a work fluid, such as air.

The closure head is configured for conveying the flow of air being suctioned and that being delivered with respect to the at least one cylinder, and it is associated with a plate provided with valves adapted to selectively control the passage of such flows.

Generally, the air to be compressed is drawn from the environment outside the compression unit and is suitably filtered to prevent dirt, dust or impurities from being introduced inside the compressor, compromising the operation thereof and contaminating the compressed air that can be delivered by the same.

During the compression process, heat is generated due not only to the transformation sustained by the fluid (adiabatic transformation), but also in part due to the frictions that take place between the moving members, and in part due to the overheating of the motor means set for driving the compression unit and connected to the same.

In order to remedy the aforesaid problem, and maintain the operating temperature of one such compression unit within a pre-established value, it is known to use forced ventilation means, comprising at least one fan operable in rotation by the aforesaid motor means, adapted to generate an air flow which externally hits the compression unit, cooling it.

One drawback of this type of compression unit regards the capacity to effectively control and reduce the temperature of the moving internal members as well as that of the compressed air exiting from the compression unit.

The forced ventilation means of the above-described type in fact does not allow effectively operating with regard to the mechanical members, operable in movement, within the compression unit, nor is it able to control and reduce the temperature of the compressed air exiting from the compression unit itself in an effective manner.

For such purpose, it is known to limit the performances of a compression unit with the goal to prevent an excessive overheating thereof and to maintain the temperature of the compressed air, exiting from one such compression unit, within a pre-established temperature interval.

In this field, the need to have a compression unit capable of overcoming the above-indicated drawbacks it is felt, according to a solution that allows an effective control of the temperature of the moving members within the compression unit and of the compressed air deliverable by the same, in the scope of a technical solution with high performances and which is simple to actuate.

SUMMARY OF THE INVENTION

Hence, the main object of the present invention is to improve the state of the art relative to a compression unit for a reciprocating compressor of the type lacking the aid of additional lubrication.

In the scope of such task, one object of the present invention is to provide a compression unit capable of ensuring an effective cooling of the moving mechanical members, set for compressing a work fluid, according to a solution that is easy to actuate and that has limited bulk with respect to that of the solutions of conventional type.

Another object of the present invention is to provide a compression unit which allows an effective control of the temperature, not only of its mechanical members operable in movement but also of the compressed work fluid exiting from the compression unit itself.

A further object of the present invention is to provide a compression unit whose maintenance is facilitated.

Another object of the present invention is to provide a compression unit which allows obtaining a high quality of the compressed air, both in terms of temperature and filtration degree thereof.

Still another object of the present invention is to provide a compression unit, for the compression of a work fluid, whose operating noise is limited with respect to that of the compression units of conventional type.

According to one aspect of the present invention, a compression unit is provided, for a compressor of reciprocating type, that lacks the aid of additional lubrication, according to the present application.

According to a further aspect of the present invention, an air compressor of the type lacking lubrication, comprising the aforesaid compression unit is provided according to the present application.

The present application refers to preferred and advantageous embodiments of the invention.

BRIEF DESCRIPTION OF THE DRAWINGS

Further characteristics and advantages of the present invention will be more evident from the detailed description of a preferred but non-exclusive embodiment of a compression unit for a reciprocating compressor, illustrated by way of a non-limiting example in the set of drawing tables in which.

DETAILED DESCRIPTION OF THE INVENTION

Figure 1:
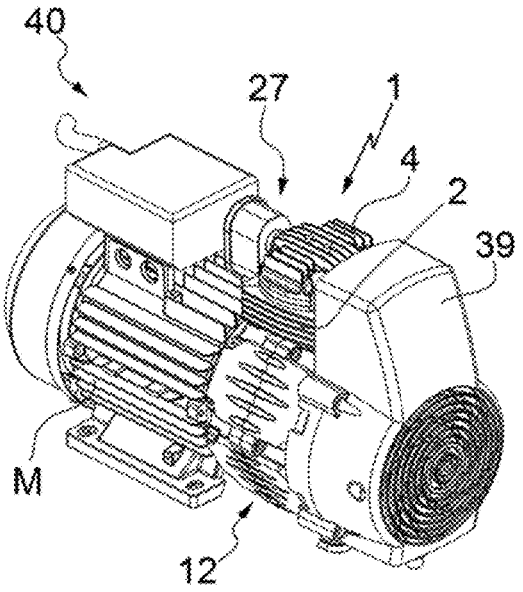
FIG. 1 is a perspective view of a compressor comprising a compression unit according to the present invention.

With reference to the enclosed figures, a compression unit according to the present invention is overall indicated with the reference number 1.

The compression unit 1 according to the present invention is provided for use in a compressor of the type lacking additional lubrication—also defined dry compressor—adapted to compress a work fluid.

The work fluid is air drawn from outside the compression unit 1 through at least one suitable opening, as better described hereinbelow.

An air compressor 40, 40' comprising at least one compression unit 1 also forms the object of the present invention.

As will be clearer hereinbelow from the following description, the compression unit 1 according to the present invention is configured for facilitating the cooling of the internal mechanical members, set for compressing of the work fluid, as well as for reducing the level of noise emitted during the operation thereof with respect to that of the solutions of conventional type. These results are attained by exploiting the fresh air flow, to be compressed, which is drawn from outside, in the scope of a solution with high efficiency and which is easy to actuate.

Furthermore, the compression unit 1 is configured to ensure a high filtering of the air to be compressed before the same is compressed, thus ensuring a high quality of the compressed air exiting from the compression unit 1.

The compression unit 1 according to the present invention comprises at least one cylinder 2, for the compression of air by means of at least one piston 3 slidably associated at its interior, with reciprocating motion with respect to a closure head 4 of the at least one cylinder 2 itself. The driving of the at least one piston 3 occurs through motor means M.

More in detail, the motor means M are operatively connected to at least one piston 3 through a drive shaft 5 operable in rotation around a rotation axis 6. The drive shaft 5, in turn, is connected to the at least one piston 3 through a connection of connecting rod/crankshaft type, indicated overall with 7, such that following the rotation of the drive shaft 5 the reciprocating travel of the at least one piston 3 is determined within the at least one cylinder 2 (see FIGS. 2, 3, 5 and 6).

The closure cap or head 4 at its interior comprises at least one suction chamber 8 and at least one expansion or delivery chamber 9 for the work fluid (see FIGS. 2, 5 and 6), for the goals which will be better described hereinbelow.

According to one aspect of the present invention, the at least one closure cap or head 4 accomplishes the task of conveying the air to be introduced into the at least one cylinder 2 (suction step) and the outflow of the compressed air (delivery step) to outside the at least one cylinder 2.

Between the closure cap or head 4 and the at least one cylinder 2, a valve plate 10 is provided that is configured for selectively controlling, in an automatic manner, the flow of the work fluid entering or exiting with respect to the at least one cylinder 2, according to modes known in the art.

The description of the valve plate 10 will be limited to those elements useful for assisting in the comprehension of the present invention.

Figure 4:
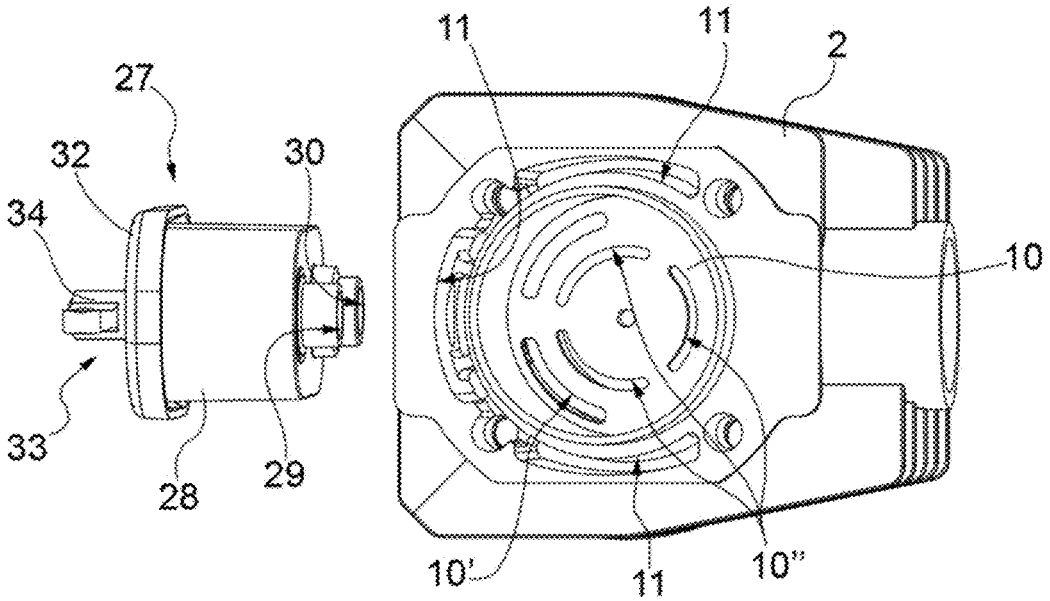
FIG. 4 is a bottom exploded view of some components of a compression unit according to the present invention.
Figure 5:
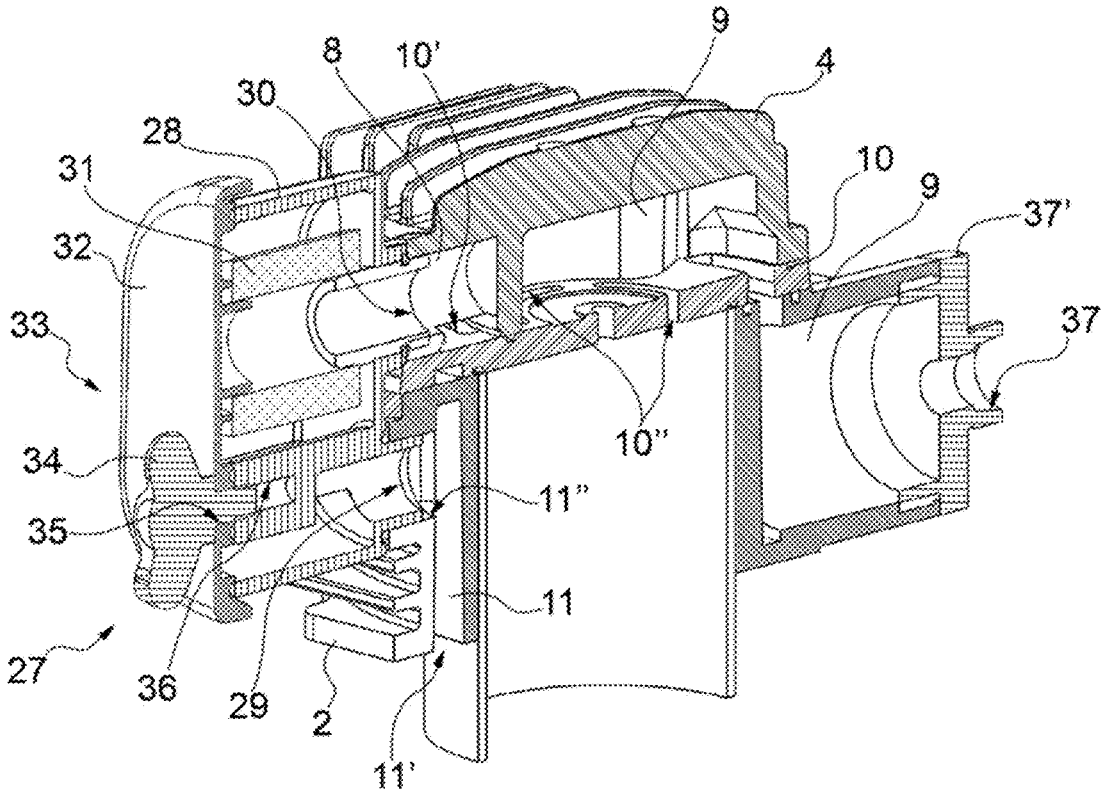
FIG. 5 is a side section view of some components of a compression unit according to the present invention.
Figure 6:
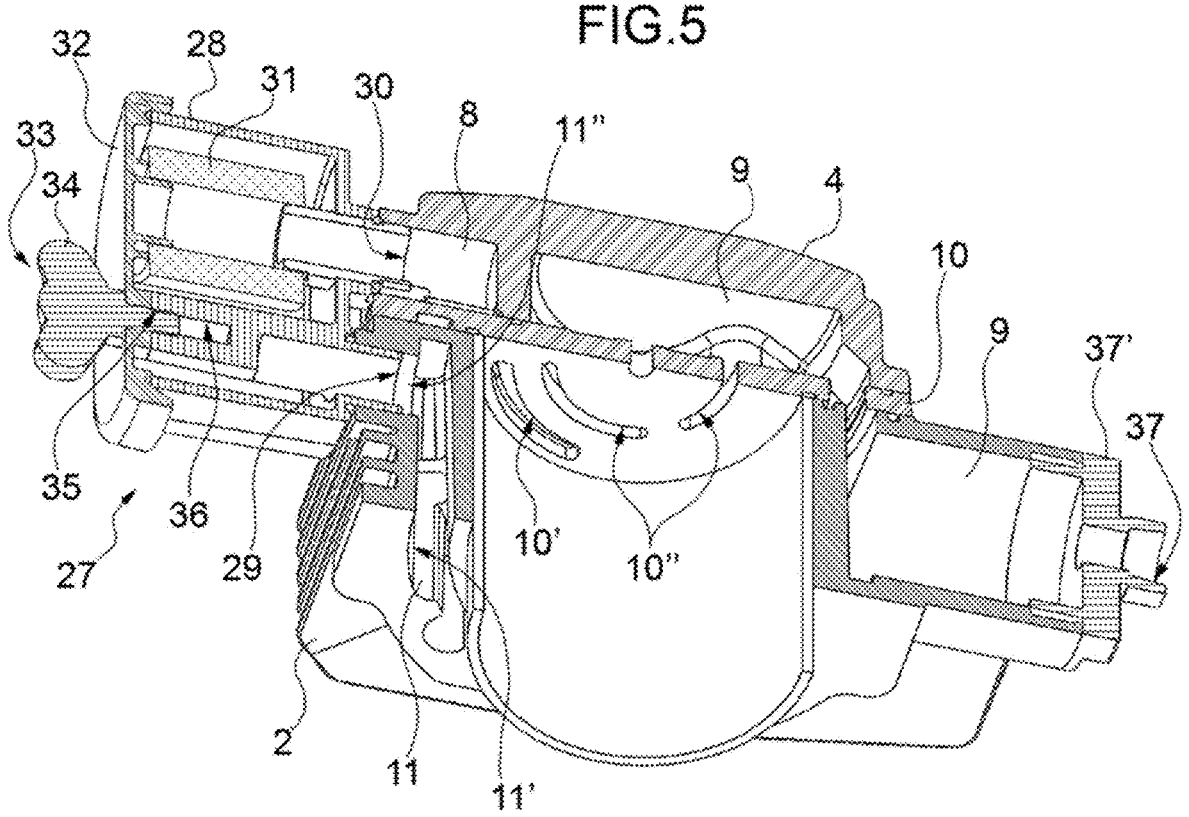
FIG. 6 is a side section view of the components pursuant to FIG. 5, according to another perspective.

For such purpose, it is observed that the valve plate 10 comprises at least one suction opening 10' and at least one delivery opening 10" respectively set to allow the passage of the air to be drawn within the at least one cylinder 2, suction step, or of the compressed air exiting from the at least one cylinder 2, delivery step, through the valve plate 10 itself (see FIGS. 4-6).

The valve plate 10 also comprises valves, not illustrated in the enclosed figures, which allow selectively opening or closing the aforesaid suction openings 10' or delivery openings 10", as a function of the variation of the pressure value within the at least one cylinder 2, determined by the movement of the at least one piston 3 therein.

As is intuitable, the at least one suction opening 10' is in selective fluid communication with the suction chamber 8 present in the closure head 4, while the at least one delivery opening 10" is in selective fluid communication with the delivery chamber 9.

The at least one cylinder 2 comprises at least one suction conduit 11 which is extended in proximity to the internal wall of the at least one cylinder 2, hitting at least part of the external surface thereof.

The at least one suction conduit 11 is associable, in fluid communication through the valve plate 10, with the interior of the at least one cylinder 2 in order to allow the passage of the fluid to be compressed within the latter.

The at least one suction conduit 11 has a first passage or opening 11' and a second passage or opening 11", opposite each other, which respectively define the inlet section and the outlet section for the flow of air along the at least one suction conduit 11.

The at least one suction conduit 11 is provided for defining a path along the external walls of the at least one cylinder 2 through which the air drawn from outside the compression unit 1 is conveyed before being introduced within the at least one cylinder 2 itself.

In fact, the passage of fresh air along the at least one suction conduit 11 determines the removal of part of the heat which is developed inside the at least one cylinder 2 during the compression process.

With reference to the version illustrated by way of example in FIG. 4, it is observed that the at least one cylinder 2 can have three suction conduits 11 which are extended around the internal wall of the at least one cylinder 2, thus enclosing or surrounding it.

It is observed that a cylinder 2 comprising a higher or lower number of suction conduits 11, possibly shaped differently from that illustrated in the enclosed figures, is still to be intended as comprised in the protective scope defined by the present invention.

The compression unit 1 according to the present invention comprises a containment and support casing 12, configured for housing and supporting at least one portion of the drive shaft 5, of the connecting rod/crankshaft kinematic mechanism 7, as well as for supporting the at least one cylinder 2.

According to one version of the present invention, the casing 12 can comprise a central body 13 with substantially cylindrical shape, delimited between lateral walls 14. The central body 13 can have a shape with central symmetry around the rotation axis 6. Further configurations of the casing 12 are nevertheless possible, also falling within the protective scope of the present invention.

According to one version of the present invention, the central body 13 can comprise two shell elements 13' that are mutually associable.

The lateral walls 14 can be associated or are associable with the central body 13 in a removable or permanent manner, or they can each be made as a single body with a respective one among the two shells 13'.

The casing 12 can have seats 15 for housing and supporting the drive shaft 5.

At the seats 15, rolling support means can be provided, indicated overall with 16, to allow the rotating support of the drive shaft 5.

Figure 2:
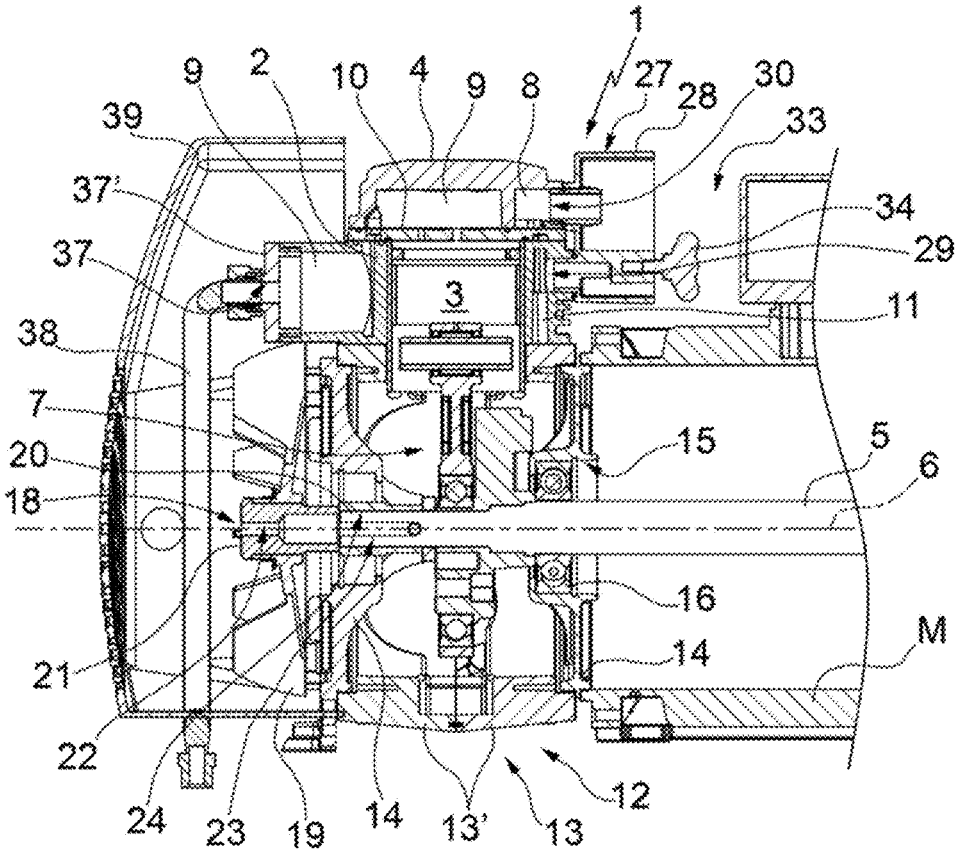
FIG. 2 is a side section view of a compression unit according to the present invention.
Figure 3:
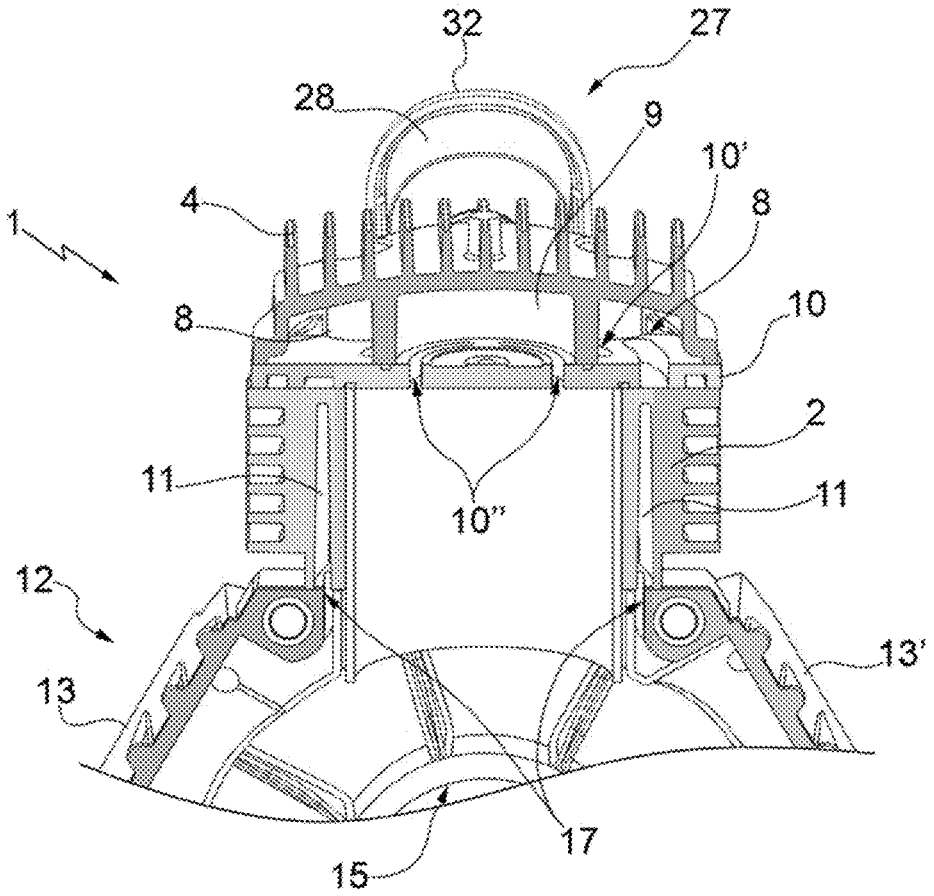
FIG. 3 is a sectional view of some components of a compression unit according to the present invention.

According to one version of the present invention, the casing 12 can comprise at least one hole or one through seat 17 which extends through one wall thereof (see FIGS. 2 and 3). The at least one hole or seat 17 is provided in a position such to allow the fluid communication between the at least one suction conduit 11 of the at least one cylinder 2 and the interior of the casing 12.

According to a preferred embodiment, the hole or seat 17 is made along the casing 12 in proximity to the zone of connection with the at least one cylinder 2.

More in detail, with the at least one cylinder 2 associated with the casing 12, the first passage 11' of the at least one suction conduit 11 at least partly faces the at least one hole or seat 17, thus allowing the placement of the at least one suction conduit 11 in fluid communication with the interior of the casing 12.

The casing 12 comprises at least one air intake 18 to allow the suction of fresh air within the compression unit 1, as better described hereinbelow.

More in detail, the at least one air intake 18 is in fluid communication with the outside of the casing 12 and, therefore, following the depression determined by the at least one piston 3 it allows drawing a fresh air flow within the casing 12.

According to one version of the present invention, the drawing of the fresh air flow within the casing 12—in addition to being caused by moving the at least one piston 3—can at least partly be determined by rotating the drive shaft 5, according to modes that will be better described hereinbelow.

The compression unit 1 has a passage for the fresh air to be compressed which is extended inside the casing 12 and, before being introduced into the at least one cylinder 2, hits the walls thereof, facilitating the cooling thereof.

The compression unit 1 comprises at least one cooling fan 19, outside the casing 12, adapted to force an air flow against the external walls of the compression unit 1 in order to facilitate the cooling thereof.

The cooling fan 19 is operatively associated with one end 20 of the drive shaft 5 which during use is extended outside the casing 12.

Following the operating in rotation of the drive shaft 5 around the rotation axis 6, the cooling fan 19 is also operated in rotation and thus generates an air flow that externally hits the compression unit 1.

According to a preferred embodiment, the cooling fan 19 can be connected at the end 20 to the drive shaft 5 through a fixing pin 21.

In particular, the connection between the fixing pin 21 and the end 20 of the drive shaft 5 can occur through a threaded connection.

Figure 8:
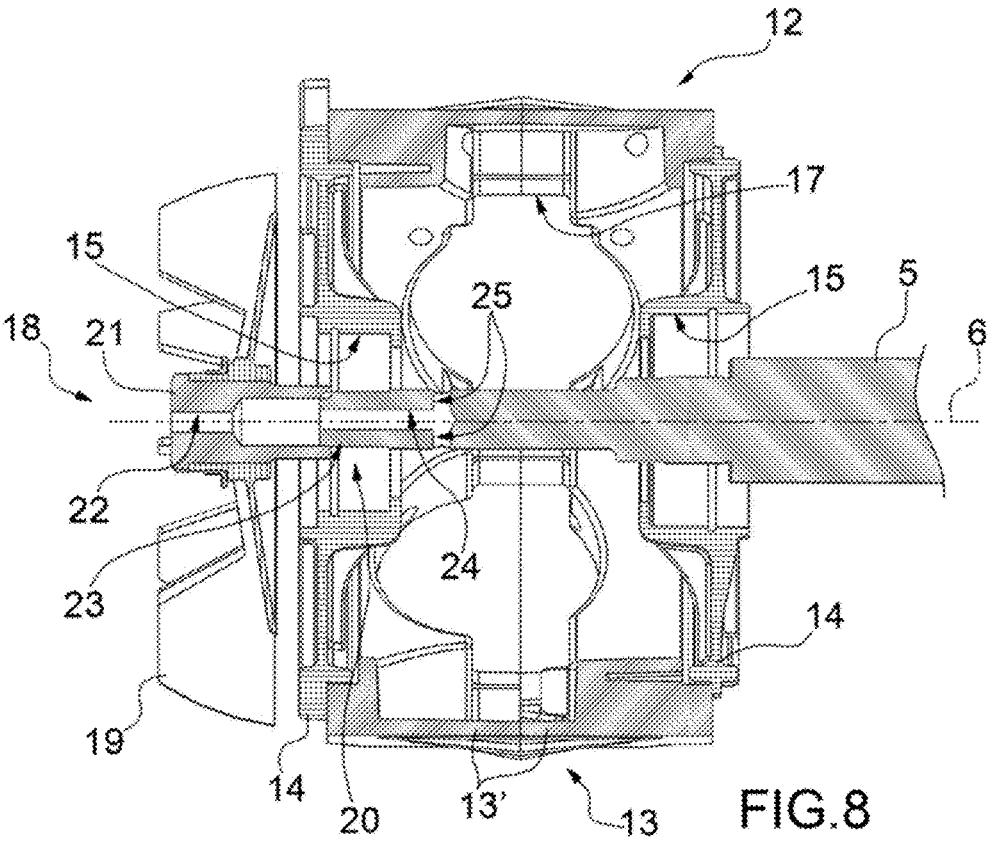
FIG. 8 is a sectional view of some components of a compression unit according to the present invention.

According to one preferred embodiment, the air intake 18 is made passing through the fixing pin 21 and at least one section of the drive shaft 5, in proximity to the end 20 (see FIGS. 2 and 8).

More in detail, the fixing pin 21 can have a first channel 22, which is extended centrally through the interior thereof. Analogously, the drive shaft 5 can have, at least in proximity to the end 20, a second channel 23, which is also extended centrally.

According to one version of the present invention, the second channel 23 can have a central section 24, which is extended in longitudinal direction along the drive shaft 5, and at least one transverse section 25, following the central section 24 and connected with the outside of the drive shaft 5 (see FIG. 8). The at least one transverse section 25 is extended along a direction transverse or radial with respect to that of the central section 24.

With reference to the embodiment illustrated in FIG. 8, it is observed that the drive shaft 5 has, in proximity to the end 20, two transverse sections 25 diametrically opposite each other, connected with the outside of the drive shaft 5 in mutually opposite positions.

It is intended that possible further embodiments of the drive shaft 5 are still possible, comprising a higher number of transverse sections 25, e.g. three, four or more, without departing from the protective scope of the present invention.

On such matter, if three or more transverse sections 25 are present, it is preferable that the same are uniformly distributed along the external circumference of the drive shaft 5, and hence with an equidistant mutual positioning according to a central symmetry identified by the drive shaft 5.

By mutually coupling the fixing pin 21 to the end 20 of the drive shaft 5, the first channel 22 faces the second channel 23, actually defining a conduit which places the interior of the casing 12 in fluid communication with the outside of the compression unit 1 through the air intake 18.

In practice, the first channel 22 and the second channel 23, when mutually associated, define the air intake 18.

The operating in rotation of the drive shaft 5 cause the at least one transverse section 25 to rotate around the rotation axis 6, generating a centrifugal effect which, together with the depression determined by the at least one piston 3, facilitates the drawing of fresh air within the casing 12.

With reference to that described above, the drawing of the fresh air flow within the casing 12 is synergistically determined by the operating in rotation of the drive shaft 5 and by the reciprocating motion of the at least one piston 3, thus allowing the increase of the flow rate of the air flow that can be drawn within the compression unit 1 without requiring the use of further mechanical means.

According to a further version of the present invention, the air intake is extended through at least one of the walls of the casing 12.

Figure 9:
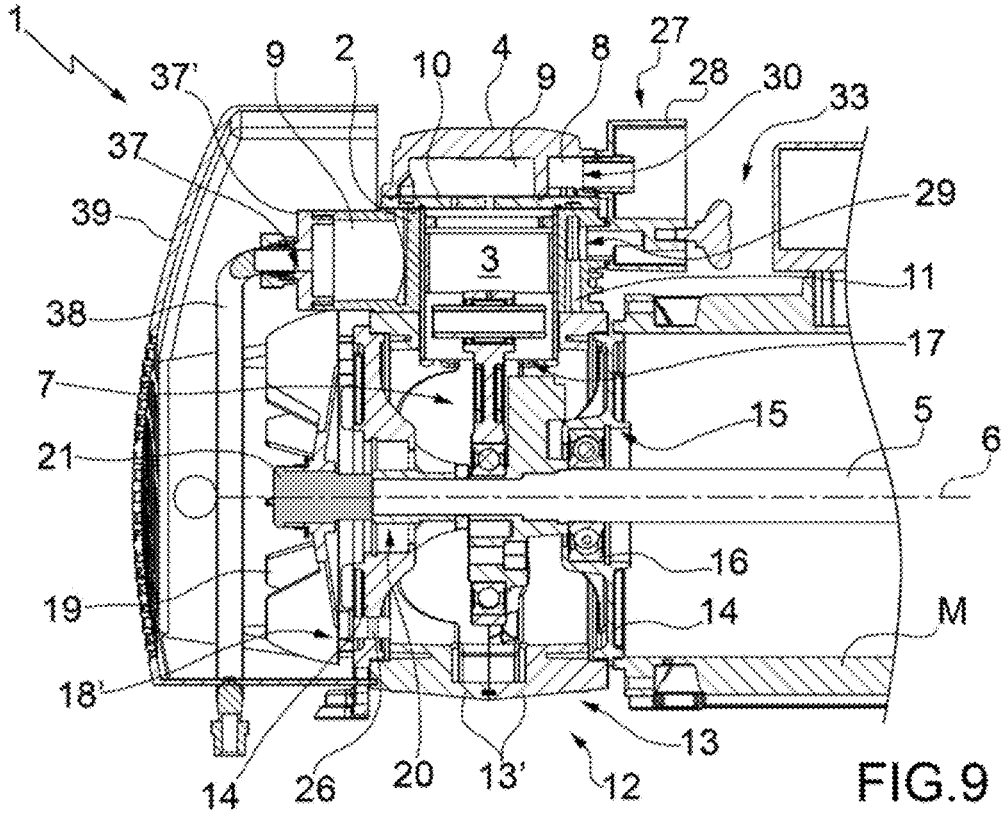
FIG. 9 is a side section view of some components of a further version of a compression unit according to the present invention.

By way of a non-limiting example, with reference to the version illustrated in the enclosed FIG. 9, the air intake 18' can be extended passing through at least one lateral wall 14. According to such version, the fixing pin 21 and the end 20 of the drive shaft 5 may lack internal channels, described for the preceding version.

Within the air intake 18', it is possible to provide for a filter 26 adapted to prevent dirt, dust or impurities from penetrating into the casing 12 and compromising the operation of the moving mechanical members (at least one piston 3, connecting rod/crankshaft 7 connection, etcetera).

According to one version, the filter 26 can be of the type configured for being permeable to air but not to liquids, such as water.

According to a further version of the present invention, not illustrated in the enclosed figures, a one-way valve can be provided in proximity to the air intake 18', to allow drawing fresh air within the casing 12 and preventing the reverse outflow thereof.

According to a further embodiment of the present invention, not illustrated in the enclosed figures, the compression unit 1 can have both previously-described air intakes 18, 18'.

As stated, the compression unit 1 comprises at least one closure cap or head 4 of the at least one cylinder 2, which delimits at least one suction chamber 8 and at least one expansion chamber 9. During use, with the closure head 4 sealingly associated with the at least one cylinder 2, the at least one suction chamber 8 is in fluid communication with the at least one suction conduit 11.

According to a further aspect of the present invention, the compression unit 1 comprises filtering means 27 adapted to filter the air that is introduced within the at least one cylinder 2.

According to one version of the present invention, the filtering means 27 are provided outside the compression unit 1, in a position interposed between the at least one suction channel 11 of the at least one cylinder 2 and the at least one suction chamber 8.

In practice, the filtering means 27 thus positioned allow completely intercepting, and hence filtering, the air flow that is introduced within the at least one cylinder 2, ensuring a high degree of filtration of the compressed air.

For such purpose, it is observed that in the compressors of conventional type, a suction conduit is provided for suctioning air outside the casing, to which filtering means are associated. If an air leak is verified through the walls of the casing or in proximity to the connection between the at least one cylinder and the casing, it is possible that part of the air introduced into the cylinder does not traverse the filtering means—and thus such air can have impurities and can contaminate the air that had actually been filtered.

On the contrary, in the compression unit 1 according to the present invention, all the air that is drawn within the at least one cylinder 2 is filtered, thus preventing impurities or dust from being present in the compressed air.

In such a manner, a high quality of the compressed air exiting from the compression unit 1 is ensured.

According to one version illustrated in the enclosed figures, the filtering means 27 comprise a box-shaped body 28 having at least one first opening 29, at least one second opening 30 and at least one filtering element 31 positionable within the box-shaped body 28, interposed between the at least one first opening 29 and the at least one second opening 30.

The at least one first opening 29 and the at least one second opening 30 allow the inflow and the outflow of the air to be filtered relative to the box-shaped body 28.

At its interior, the box-shaped body 28 is configured to define, together with the filtering element 31, a pre-established path along which the air to be filtered can flow (see FIGS. 5 and 6).

At least one from among the at least one first opening 29 and the at least one second opening 30 can be sealingly connected with at least one from among the second passage 11" of the at least one suction conduit 11 and the at least one suction chamber 8, and the other from among the at least one second opening 30 and the at least one first opening 29 is sealingly engageable with the other from among the at least one suction chamber 8 and the second passage 11" of the at least one suction conduit 11.

In practice, the filtering means 27 are positioned immediately upstream of the suction chamber 8.

Hence, in fact, the filtering means 27 are configured for completely intercepting the air flow drawn within the at least one cylinder 2 due to the action of the at least one piston 3.

The filtering element 31 can be configured as a filter of spongy type, or a paper filter, or a similar element suitable for such purpose.

According to one version of the present invention, the box-shaped body 28 comprises a closure lid 32 removably associable, with hermetic seal, to the box-shaped body 28 itself.

For such purpose, connection means 33 can be provided for allowing the connection, of removable type, between the box-shaped body 28 and the closure lid 32.

The connection means 33 can be shaped as shape coupling means, snap coupling means or fitting means, or provide for a threaded connection.

According to one version of the present invention, the connection means 33 can comprise an associable screw element 34 passing through an opening 35 made in the closure lid 28, and engageable in a respective threaded seat 36 provided in the box-shaped body 28.

The screw 34 can comprise a head portion configured for being manually grippable and actuatable by a user, hence without requiring the use of any tool.

The closure lid 32 allows easily freeing a passage for accessing inside the box-shaped body 28. In particular, by removing the closure lid 32 from the box-shaped body 28, it is possible to easily access the filtering element 31 present within the latter, so to be able to execute the maintenance thereof or simply to verify the integrity thereof, the degree of dirtiness or possibly to be able to substitute it with a new filtering element 31.

Regarding the possibility to cool the compressed air deliverable from a compression unit 1, the presence in the closure head 4 of at least one expansion chamber 9 (see FIGS. 2, 3, 5 and 6) is underlined.

As known, during the compression process, the temperature of the air within the at least one cylinder 2 increases. The presence of an expansion chamber 9, along the delivery path, at the outlet from the compression unit 1 allows a controlled expansion of the compressed air and hence a reduction of the temperature thereof.

The expansion chamber 9 has a delivery opening 37 to which a delivery conduit 38 is sealingly connected, such conduit extended outside the compression unit 1.

The delivery opening 37 can be delimited by a closure element 37' configured for conveying the compressed air exiting from the expansion chamber 9 (see FIGS. 5 and 6).

According to one version of the present invention, the closure element 37' can be configured as a cap or a similar element removably associable at one end of the expansion chamber 9. By removing the closure element 37', it is possible to free up an access passage within the expansion chamber 9 so to be able to execute the maintenance thereof.

The delivery conduit 38 can be connected to a user, to a circuit for the distribution of the compressed air or to a storage tank, not illustrated in the enclosed figures.

For such purpose, it is observed that the delivery conduit 38 is extended in frontal position with respect to the cooling fan 19 through the region affected by the air flow generated thereby.

Such positioning of the delivery conduit 38 allows further lowering the temperature of the compressed air that can be delivered by the compression unit 1, since the delivery conduit 38 is hit, and then cooled, by the air flow generatable by the fan during the operation of the compression unit 1.

In order to increase the efficiency of the forced ventilation generated by the cooling fan 19, a fan cover fairing 39 can be provided that is adapted to convey the air flow entering and exiting relative to the cooling fan 19 itself.

The fan cover 39 also acts as a safety element defining a protection barrier.

The delivery conduit 38 is provided in a position interposed between the cooling fan 19 and the fan cover fairing 39.

Reported hereinbelow, in brief, is the operation of a compression unit 1 according to the present invention.

With the rotation of the drive shaft 5 around the rotation axis 6, by motor means M, the movement of at least one piston 3 within the at least one cylinder 2 is determined.

The piston 3 cyclically causes a depression within the at least one cylinder 2 which is propagated within the casing 12 through the at least one suction conduit 11, with which it is in fluid communication. In turn, the casing 12 has at least one air intake 18, 18' through which the air to be compressed is drawn within the casing 12.

The fresh air, entering into the casing 12, follows a "suction" path, i.e. a path through the internal volume of the casing 12 and hence along the at least one suction conduit 11 up to reaching the suction chamber 8 of the closure head 4 of the at least one cylinder 2 before being introduced within the latter in order to be subsequently compressed. Along such "suction" path, the air initially hits the internal mechanical members, operable in movement, of the compression unit 1 and then the external walls of the at least one cylinder 2, cooling them.

In particular, the fresh air which is drawn within the casing 12 through the air intake 18, 18', before traversing the at least one suction conduit 11, hits the drive shaft 5, the possible rolling support means 16 and the connecting rod/crankshaft 7 connection, cooling them and thus allowing the lowering of the temperature thereof.

In the compression units of conventional type, however, the moving internal members are not hit by a similar fresh air flow and therefore it is not possible to obtain a cooling thereof according to the modes provided in the present invention.

Subsequently, the fresh air flow to be compressed traverses the at least one suction conduit 11, hitting the lateral walls of the at least one cylinder 2, removing the excess heat thereof.

Before being introduced within the at least one cylinder 2, the air flow is conveyed within the filtering means 27 which retain possible impurities present therein. Then, at the end of the compression step, the compressed air flows outward from the valve plate 10 and traverses the expansion chamber 9 where, after the expansion, it yields part of the heat acquired during the previous compression step.

In exiting from the expansion chamber 9, the compressed air traverses the external delivery conduit 38, which is cooled by the forced air flow generated by the cooling fan 19.

From that described above, it is inferred that the compression unit 1 according to the present invention is able to attain the preset objects.

Indeed, in addition to the cooling action exerted by the cooling fan 19, a further cooling is obtained in the compression unit 1 by exploiting the fresh air to be compressed, hence without requiring the use of further ventilation means or dedicated cooling circuits.

In addition, the presence of an expansion chamber 9, along the delivery path, allows reducing the temperature of the compressed air, to the benefit of the users placed downstream of the compression unit 1 itself.

The possibility of effectively cooling not only the compressed air but also the internal mechanical members set for the compression thereof allows increasing the overall duration of the life cycle of the compression unit 1, reducing the thermal fatigue to which such components are subjected during use and the relative maintenance.

The temperature of the compressed air exiting from a compression unit 1 according to the present invention can be lower than that delivered by a compression unit of conventional type, given the same power, by a value comprised between about 40° C. and 80° C.

The path provided for the air drawn from outside along the compression unit 1, before being introduced into the at least one cylinder 2, allows defining a point, outside the compression unit 1, at which the air flow is intercepted in order to be able to execute an effective filtration thereof. For such purpose, it is underlined that filtering means 27, being outside the compression unit 1, are easy to access, facilitating the maintenance thereof.

The set of structural solutions employed in a compression unit 1 according to the present invention, with particular reference to the configuration of the suction path for the air to be compressed, in addition to allowing the attainment of the above-described benefits, also facilitates the reduction of the operating noise level of compression unit 1 itself, also in the scope of a solution with high efficiency and performance.

Figure 7:
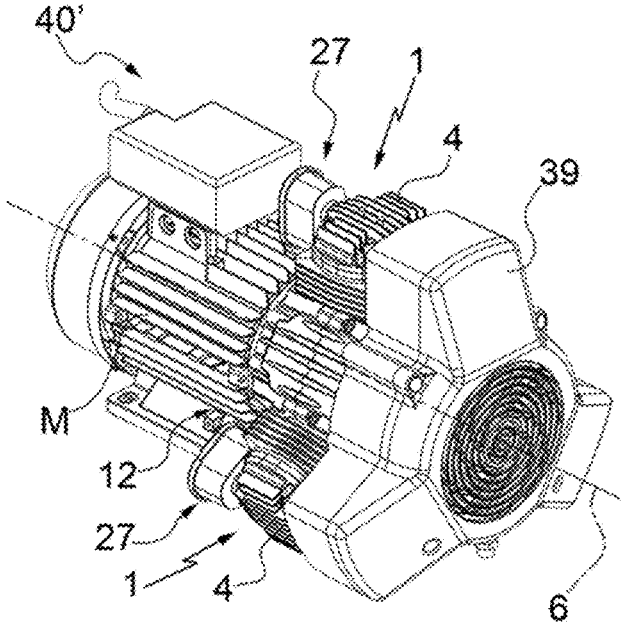
FIG. 7 is a perspective view of a further version of a compressor comprising three compression units according to the present invention.

Finally, it is observed that in the preceding description, reference has been made to a compressor 40 comprising a single compression unit 1 according to the present invention. On such matter, it is specified that a compressor equipped with two or more compression units 1 is still to be intended as comprised in the protective scope of the present invention. By way of example, in FIG. 7, a compressor 40' is illustrated comprising three compression units 1 arranged equidistant from each other with a central symmetry with respect to the rotation axis 6. In such case, the compressor 40' comprises three pistons 3 associated with a drive shaft 5 through respective connecting rod/crankshaft 7 connections.

According to one version of such compressor 40', the delivery conduits 38 exiting from each cylinder 2 can be shaped in order to be connected with each other to define a single point of collection of the compressed air usable by users downstream of the compressor.

The compression unit 1 for a compressor of the type lacking lubrication, described above, is susceptible of numerous modifications and variants within the protective scope of the following claims.

The invention claimed is:

1. A compression unit, for a volumetric compressor, comprising at least one cylinder for the suction and the compression of air by means of at least one piston sliding in said at least one cylinder, said at least one cylinder comprising at least one suction conduit extending in proximity to an internal wall of said at least one cylinder, a drive shaft, operable in rotation around a rotation axis and associated with said at least one piston through a connecting rod/crankshaft kinematic mechanism, the rotation of said drive shaft controlling the reciprocating motion of said at least one piston, a casing configured to receive and support each of said at least one cylinder and for housing of at least one portion of said drive shaft and of said connecting rod/crankshaft kinematic mechanism, wherein said casing comprises at least one air intake in communication with an outside of said compression unit and delimiting at least one passage for the air to be drawn therein and to be supplied to said at least one cylinder, in which said at least one air intake is in fluid communication with the inside of said at least one cylinder through a suction path which develops inside said casing and passes along external walls of said at least one cylinder, wherein said air which is drawn within said casing through said at least one air intake, before traversing said at least one suction conduit, hits said drive shaft and said connecting rod/crankshaft kinematic mechanism, cooling them, further comprising at least one cooling fan external to said casing, connectable to one end of said drive shaft through a fixing pin, wherein said air intake is made so as to pass through said fixing pin and along at least one section of said drive shaft at said one end, with said pin and said drive shaft mutually connected.

2. The compression unit according to claim 1, wherein said casing comprises at least one hole which develops through a wall of said casing, at a connection between the casing and said at least one cylinder, wherein each said hole is adapted to bring into fluid communication the inner volume of said casing with the suction path which develops along at least one section of the external walls of said at least one cylinder.

3. The compression unit according to claim 1, wherein said fixing pin has a first channel which extends centrally along said fixing pin, and said drive shaft has a second channel, which is associated in fluid communication with said first channel, wherein said second channel has a central section, extending in longitudinal direction along said drive shaft and at least one transversal section which develops consecutively to said central section in transversal or radial direction and opens to the outside of said drive shaft.

4. The compression unit according to the claim 3, wherein said central section extends along at least one section of said drive shaft starting from said one end.

5. The compression unit according to claim 1, wherein said air intake extends passing through at least one lateral wall of said casing.

6. The compression unit according to claim 1, comprising at least one closure cap of said at least one cylinder, said at least one closure cap having at least one suction chamber in fluid communication with said at least one suction conduit, and wherein said at least one closure cap further comprises at least one expansion chamber to control expansion of said compressed air exiting said at least one cylinder.

7. The compression unit according to claim 6, comprising filtering means adapted to filter the air drawn inside said at least one cylinder by said at least one piston, in which said filtering means are provided externally to said casing in an interposed position between said at least one suction conduit of said cylinder and said at least one suction chamber of said at least one closure cap.

8. The compression unit according to claim 7, wherein said filtering means comprise a box-shaped body that is externally associated with said casing and comprises a first opening, at least one second opening and at least one filtering element placed inside said box-shaped body in an interposed position between said first opening and said second opening, said box-shaped body and said filtering element defining a forced filtering path for said air inside said filtering means.

9. The compression unit according to the claim 8, wherein at least one of said first opening and said at least one second opening is sealingly engageable to hold at least one of said at least one suction conduit of said at least one cylinder and said at least one suction chamber of said at least one closure cap and the other of said at least one second opening and said first opening is sealingly engageable with the other of said at least one suction chamber and said at least one suction conduit.

10. The compression unit according to claim 8, wherein said box-shaped body comprises one closing lid connectable in a removable manner to said box-shaped body to facilitate the access to said at least one filtering element.

11. The compression unit according to claim 10, comprising connection means for the connection between said closure lid and said box-shaped body.

12. A compression unit, for a volumetric compressor, comprising at least one cylinder for the suction and the compression of air by means of at least one piston sliding in said at least one cylinder, said at least one cylinder comprising at least one suction conduit extending in proximity to an internal wall of said at least one cylinder, a drive shaft, operable in rotation around a rotation axis and associated with said at least one piston through a connecting rod/crankshaft kinematic mechanism, the rotation of said drive shaft controlling the reciprocating motion of said at least one piston, a casing configured to receive and support each of said at least one cylinder and for housing of at least one portion of said drive shaft and of said connecting rod/crankshaft kinematic mechanism, wherein said casing comprises at least one air intake in communication with an outside of said compression unit and delimiting at least one passage for the air to be drawn therein and to be supplied to said at least one cylinder, in which said at least one air intake is in fluid communication with the inside of said at least one cylinder through a suction path which develops inside said casing and passes along external walls of said at least one cylinder, wherein said air which is drawn within said casing through said at least one air intake, before traversing said at least one suction conduit, hits said drive shaft and said connecting rod/crankshaft kinematic mechanism, cooling them, further comprising at least one cooling fan external to said casing, connectable to one end of said drive shaft through a fixing pin, wherein said air intake is made so as to pass through said fixing pin and along at least one section of said drive shaft at said one end, with said pin and said drive shaft mutually connected wherein said fixing pin has a first channel which extends centrally along said fixing pin, and said drive shaft has a second channel, which is associated in fluid communication with said first channel, wherein said second channel has a central section, extending in longitudinal direction along said drive shaft and at least one transversal section which develops consecutively to said central section in transversal or radial direction and opens to the outside of said drive shaft.

13. A compression unit, for a volumetric compressor, comprising at least one cylinder for the suction and the compression of air by means of at least one piston sliding in said at least one cylinder, said at least one cylinder comprising at least one suction conduit extending in proximity to an internal wall of said at least one cylinder, a drive shaft, operable in rotation around a rotation axis and associated with said at least one piston through a connecting rod/crankshaft kinematic mechanism, the rotation of said drive shaft controlling the reciprocating motion of said at least one piston, a casing configured to receive and support each of said at least one cylinder and for housing of at least one portion of said drive shaft and of said connecting rod/crankshaft kinematic mechanism, wherein said casing comprises at least one air intake in communication with an outside of said compression unit and delimiting at least one passage for the air to be drawn therein and to be supplied to said at least one cylinder, in which said at least one air intake is in fluid communication with the inside of said at least one cylinder through a suction path which develops inside said casing and passes along external walls of said at least one cylinder, wherein said air which is drawn within said casing through said at least one air intake, before traversing said at least one suction conduit, hits said drive shaft and said connecting rod/crankshaft kinematic mechanism, cooling them, wherein said casing comprises at least one hole which develops through a wall of said casing, at a connection between the casing and said at least one cylinder, wherein each said hole is adapted to bring into fluid communication the inner volume of said casing with the suction path which develops along at least one section of the external walls of said at least one cylinder, comprising at least one closure cap of said at least one cylinder, said at least one closure ca having at least one suction chamber in fluid communication with said at least one suction conduit, and further comprising filtering means adapted to filter the air drawn inside said at least one cylinder by said at least one piston, in which said filtering means are provided externally to said casing in an interposed position between said at least one suction conduit of said cylinder and said at least one suction chamber of said at least one closure cap.

* * * * *